US009211578B2

(12) United States Patent
Hayashi

(10) Patent No.: US 9,211,578 B2
(45) Date of Patent: Dec. 15, 2015

(54) UPPER TOOL HOLDER FOR PRESS BRAKE

(75) Inventor: Shiro Hayashi, Kanagawa (JP)

(73) Assignee: AMADA COMPANY, LIMITED, Kanagawa (JP)

( * ) Notice: Subject to any disclaimer, the term of this patent is extended or adjusted under 35 U.S.C. 154(b) by 0 days.

(21) Appl. No.: 14/344,156

(22) PCT Filed: Aug. 27, 2012

(86) PCT No.: PCT/JP2012/071584

§ 371 (c)(1),
(2), (4) Date: Jul. 25, 2014

(87) PCT Pub. No.: WO2013/058017

PCT Pub. Date: Apr. 25, 2013

(65) Prior Publication Data

US 2014/0326036 A1 Nov. 6, 2014

(30) Foreign Application Priority Data

Oct. 20, 2011 (JP) ..... 2011-230532

(51) Int. Cl.

| | |
|---|---|
| ***B21D 37/00*** | (2006.01) |
| ***B21D 5/02*** | (2006.01) |
| ***B21D 37/04*** | (2006.01) |
| ***B21D 37/14*** | (2006.01) |

(52) U.S. Cl.
CPC ..... *B21D 5/0236* (2013.01); *B21D 37/04* (2013.01); *B21D 37/14* (2013.01)

(58) Field of Classification Search
CPC ..... B21D 37/04; B21D 37/14; B21D 5/0236
USPC ..... 72/481.1, 481.2, 481.6, 482.1, 482.3, 72/482.6, 482.91
See application file for complete search history.

(56) References Cited

U.S. PATENT DOCUMENTS

| | | | | |
|---|---|---|---|---|
| 6,003,360 | A | 12/1999 | Runk et al. | |
| 6,263,721 | B1 * | 7/2001 | Kawano | 72/481.6 |
| 7,632,224 | B2 * | 12/2009 | Rouweler et al. | 483/28 |
| 7,810,369 | B2 * | 10/2010 | Rouweler et al. | 72/482.1 |

(Continued)

FOREIGN PATENT DOCUMENTS

| | | |
|---|---|---|
| JP | 11-028519 | 2/1999 |
| JP | 2002-239632 | 8/2002 |
| JP | 2009-514680 | 4/2009 |
| WO | 2007/054121 | 5/2007 |

OTHER PUBLICATIONS

International Search Report, mail date is Nov. 20, 2012.

*Primary Examiner* — David B Jones
(74) *Attorney, Agent, or Firm* — Greenblum & Bernstein, P.L.C.

(57) ABSTRACT

An upper tool holder for holding an upper tool of a press brake exchangeably, includes a holder main body; an attachment portion provided on an upper portion of the holder main body; a support portion provided on a lower portion of the holder main body; a clamp provided swingably at a vertically intermediate position of the holder main body; an actuator that includes a pushing member for pushing the upper portion of the clamp to fix the upper tool with the support portion; and an open restriction member that has an open restriction portion for restricting the clamp. The open restriction member is provided at a position distanced from a pushed position of the upper portion of the clamp by the pushing member. According to the upper tool holder, the upper tool can be held firmly by the clamp.

4 Claims, 4 Drawing Sheets

(56) References Cited

U.S. PATENT DOCUMENTS 8,943,870 B2 * 2/2015 Rouweler et al. ..... 72/481.1
2003/0005744 A1 1/2003 Gasparini
2004/0074278 A1 4/2004 Hayashi et al.
2009/0217731 A1 9/2009 Rouweler et al.

* cited by examiner

UPPER TOOL HOLDER FOR PRESS BRAKE

TECHNICAL FIELD

The present invention relates to an upper tool holder for holding an upper tool of a press brake exchangeably.

BACKGROUND ART

An upper tool holder for holding an upper tool is provided at a lower portion of an upper table of a press brake. The upper tool holder includes a holder main body attached to the lower portion of the upper table, and a clamp attached to the holder main body. The clamp is swingably attached to the holder main body. In addition, the holder main body also includes a fluid pressure cylinder that has a piston rod for pushing an upper portion of the clamp forward. The fluid pressure cylinder is able to stroke the piston rod backward and forward. Then, at a pushed position of the clamp by an end of the piston rod, a screw member as a pushed member is screwed movably backward and forward (e.g. Patent Document 1 listed below).

In the upper tool holder, a lower portion of the clamp is swung backward when the end of the piston rod of the fluid pressure cylinder pushes the screw member forward, and thereby the upper tool is held between the clamp and the holder main body. On the other hand, when working fluid pressure of the fluid pressure cylinder is reduced, the upper tool is unclamped. In an unclamped state of the upper tool, a wedge piece attached to the lower portion of the clamp engages with a drop prevention groove formed laterally on the upper tool, and thereby the upper tool is held laterally-slidably by the upper tool holder.

Therefore, when exchanging a laterally long upper tool by sliding it laterally, the upper tool can be prevented from dropping off and operations for exchanging the upper tool can be done safely.

In the above-explained upper tool holder, when exchanging a laterally long upper tool from beneath of the upper tool holder, the clamp is widely opened. In this case, since the clamp cannot be widely opened when the above-explained screw member and the end of the piston rod are contacted with each other, the screw member is retracted into the clamp by being turned. By avoiding contacts between the screw member and the end of the piston rod, the upper tool can be exchanged from beneath of the upper tool holder by opening the clamp widely to disengage the wedge piece from the drop prevention groove.

PRIOR ART DOCUMENT

Patent Document

Patent Document 1: Japanese Patent Application Laid-Open No. 2002-239632

SUMMARY OF INVENTION

However, if the screw member is not brought back to its original state after exchanging the upper tool from beneath of the upper tool holder, it becomes impossible to close the clamp by the piston rod. In this case, fixation of the upper tool becomes insufficient.

Therefore, an object of the present invention is to provide an upper tool holder that can fix an upper tool surely by a clamp.

An aspect of the present invention provides an upper tool holder for holding an upper tool of a press brake exchangeably, comprising: a holder main body; an attachment portion to an upper table of the press brake, that is provided on an upper portion of the holder main body; a support portion that the upper tool is to be fixed with, and provided on a lower portion of the holder main body; a clamp that is provided swingably at a vertically intermediate position of the holder main body; an actuator that includes a pushing member for pushing the upper portion of the clamp, and fixes the upper tool with the support portion by pushing the upper portion of the clamp by the pushing member; and an open restriction member that has an open restriction portion for restricting, when the upper tool is not fixed with the support portion, the clamp from opening from a position for holding the upper tool in a laterally slidable state, wherein the open restriction member is provided at a position distanced from a pushed position of the upper portion of the clamp by the pushing member with an insertion thereof between the clamp and the holder main body enabled.

According to the aspect, since the open restriction member restricts the clamp from opening from its position for holding the upper tool in a laterally slidable state is provided at the position distanced from the pushed position of the upper portion of the clamp by the pushing member with an insertion thereof between the clamp and the holder main body enabled, the pushing member can push the clamp regardless of a position of the open restriction member. Therefore, the clamp can swing to a position for fixing the upper tool with the support portion, and thereby the upper tool can be fixed surely.

Here, it is preferable that, when the pushing member pushes the upper portion of the clamp to fix the upper tool with the support portion, the pushing member keeps the clamp at a constant fixed position regardless of a position of the open restriction member.

In addition, it is preferable that the clamp has a lock pin contactable with the open restriction member, the lock pin is biased toward a direction for projecting an end thereof, a projected direction of the lock pin intersects with a slide direction of the open restriction member, the clamp is restricted from opening by a contact of an end surface of the lock pin with the open restriction portion, when the open restriction member is positioned at an open restriction position for restricting the clamp from opening, and the clamp is allowed to open by a projection of the lock pin and a contact of a side face of an end of the lock pin with the open restriction portion to restrict the open restriction portion from returning to the restriction position, when the open restriction member is not positioned at the open restriction position.

DESCRIPTION OF EMBODIMENTS

Figure 1:
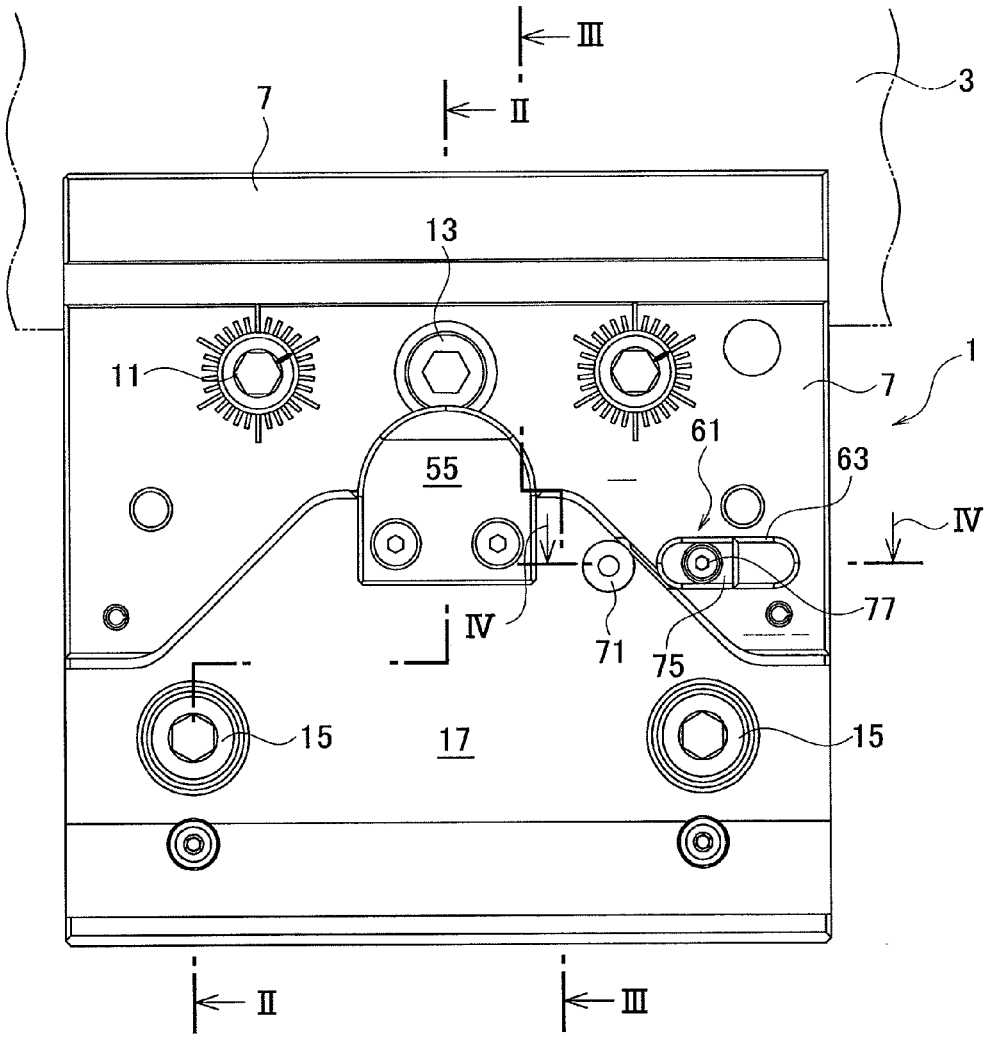
[FIG. 1] It is a front view of an upper tool holder according to an embodiment.
Figure 2:
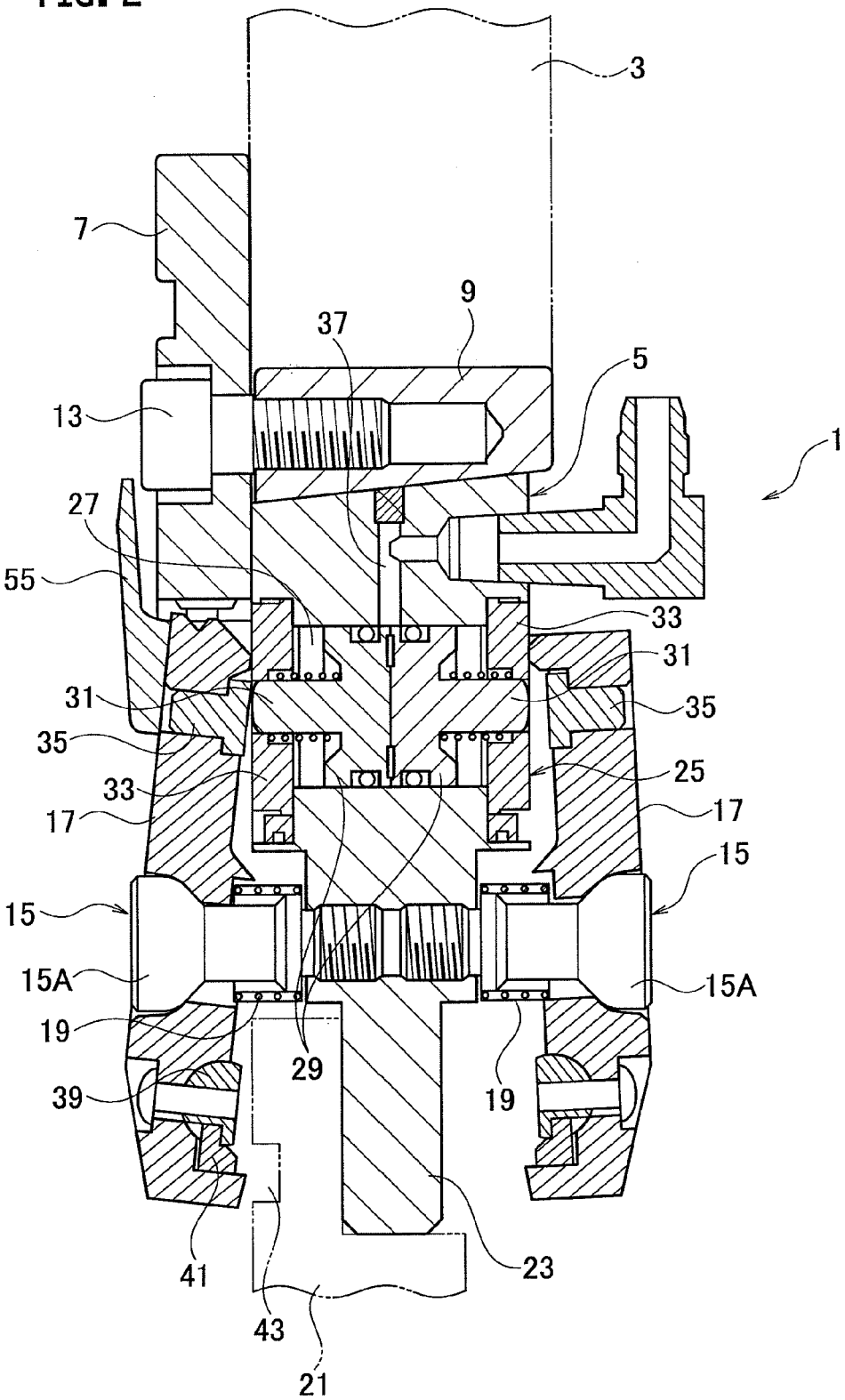
[FIG. 2] It is a cross-sectional view taken along a line II-II shown in FIG. 1.

As shown in FIG. 1 and FIG. 2, an upper tool holder 1 according to the present embodiment includes a holder main body 5 that has an attachment portion to an upper table 3 of a press brake at its upper portion. An attachment plate 7 is attached to a front upper face of the holder main body 5 by plural pins (fixtures). The attachment plate 7 is fixed with the upper table 3 by a clamp jaw (not shown) attached to a front face of the upper table 3.

As shown in FIG. 2, au upper surface of the holder main body 5 is formed as a sloped surface slanted in a back-and-forth direction (a right-to-left direction in FIG. 2). A wedge member 9 having a sloped surface that planarly contacts with the upper surface of the holder main body 5 is provided above the holder main body 5. An upper surface of the wedge member 9 contacts planarly with a lower surface of the upper table 3. Ends of push bolts 11 (see FIG. 1) threadably mounted on the attachment plate 7 are contacted onto a front face of the wedge member 9. In addition, a pull bolt 13 (see FIG. 1 and FIG. 2) that penetrates the attachment plate 7 is threadably mounted on the front face of the wedge member 9.

The wedge member 9 can be moved backward (rightward in FIG. 2) by loosening the push bolts 11, and the wedge member 9 can be moved forward (leftward in FIG. 2) by fastening the push bolts 11. Namely, a back-and-forth position of the wedge member 9 can be adjusted by the push bolts 11 and the pull bolt 13. In addition, when the back-and-forth position of the wedge member 9 is adjusted, a vertical position of the holder main body 5 can be adjusted by the above-explained sloped surfaces.

At a vertically intermediate position of the holder main body 5, plural support shafts 15 are provided horizontally along the back-and forth direction. Plate-shaped clamps 17 are attached to the holder main body 5 swingably by the support shafts 15. Each of the support shafts. 15 has a head 15H that supports the clamp 17. The head 15H contacts with a spherical concave surface formed on the clamp 17. The clamp 17 swings by contacting the head(s) 15H slidably with the spherical concave surface(s). Elastic members (coil springs) 19 for biasing the clamps 17 to distance them from the holder main body 5 are provided between the holder main body 5 and the clamps 17.

Actuators 25 for pushing upper portions of the clamps 17 are provided at the upper portion of the holder main body 5. One of the actuators 25 will be explained, but another of them also functions similarly and symmetrically (an after-explained cylinder chamber 27 is communally used by them). The actuator 25 pushes the upper portion of the clamp 17 to distance it from the holder main body 5, and thereby closes a lower portion of the clamp 17. When the lower portion of the clamp 17 is closed, an upper portion of the upper tool 21 is held and fixed by the lower portion of the clamp 17 and a support portion 23 that is a lower portion of the holder main body 5.

The actuator 25 will be explained in more detail. A cylinder chamber 27 formed along the back-and-forth direction is formed in the holder main body 5. A pair of slidable pistons (actuating members) 2 is housed oppositely in the cylinder chamber 27. A piston rod (pushing member) 31 formed on each of the pistons 29 penetrates a cover member 33 that closes the cylinder chamber 27. An end of the piston rod 31 faces a contact member (pushed member) 35 attached to the clamp 17, and is contacted with the contact member 35 or separated from the contact member 35.

Therefore, working fluid is supplied from a working fluid passage 37 formed in the holder main body 5 into the cylinder chamber 27, and thereby the piston 29 is stroked outward. Along with the outward stroke of the piston 29, the piston rod 31 is projected outward, and its end pushes the contact member 35. As a result, the lower portion of the clamp 17 is closed, and then the upper tool 21 is fixed with the support portion 23. When the upper tool 21 is fixed with the support portion 23 with the lower portion of the clamp 17 closed by the piston rod 31, the clamp 17 is always kept at a constant position, i.e. a fixed position, by the piston rod 31.

When the upper tool 21 is fixed with the support portion 23 by the clamp 17, a pressing piece 39 provided at the lower portion of the clamp 17 is planarly contacted with the upper tool 21. The pressing piece 39 has a half-round cross-sectional shape, and provided rotatably. In addition, a drop prevention member 41 is provided toward the upper tool 21 at the lower portion of the clamp 17. The drop prevention member 41 has a wedged cross-sectional shape, and is to be engaged with a drop prevention groove 43 formed on the upper tool 21. The drop prevention member 41 and the drop prevention groove 43 are provided laterally.

In order to prevent the lower portion of the clamp from opening while pushing by the piston rod 31 is cancelled, a biasing mechanism 45 (see FIG. 3) that biases the upper potion of the clamp 17 forward (leftward in FIG. 2 and FIG. 3) is provided. In the biasing mechanism 45, a slidable pushing pin 49 is housed in a through hole 47 formed at the upper potion of the holder main body 5. A stopper screw 51 is threadably mounted at a rear portion in the through hole 47, and a coil spring 53 is interposed between the pushing pin 49 and the stopper screw 51. The pushing pin 49 is projected forward by the coil spring 53 to bias the upper portion of the clamp 17 forward. Therefore, the lower portion of the clamp 17 is restricted from opening widely by the pushing pin 49.

Figure 3:
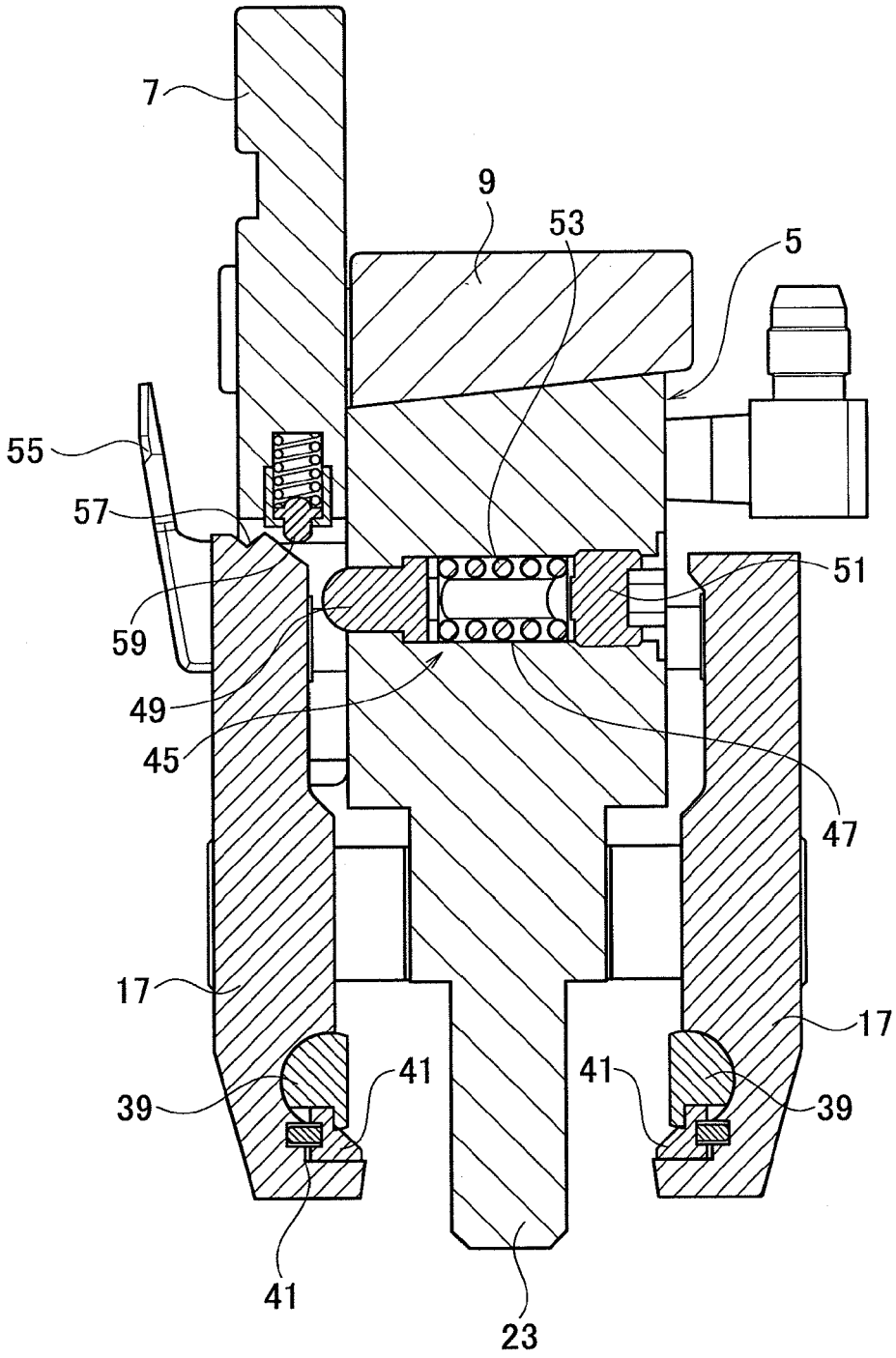
[FIG. 3] It is a cross-sectional view taken along a line shown in FIG. 1.

Note that, when the upper portion of the clamp 17 is pressed backward (rightward in FIG. 2 and FIG. 3) against a biasing force of the coil spring 53, the lower portion of the clamp 17 can be opened widely. In addition, as shown in FIG. 3, a plunger mechanism is provided in order to keep an opened state where the lower portion of the clamp 17 is widely opened by moving the upper potion of the clamp 17 backward against the biasing force of the biasing mechanism 45. Further, a press lever 55 is provided at the upper portion of the clamp in order to press the upper portion of the clamp 17 backward.

In the plunger mechanism, a notch 57 is formed on an upper surface of the clamp 17, and an engagement member 59 (a ball, a pin and so on) that can be engaged with the notch 57 is provided at a position associated with the notch 57 on the attachment plate 7. Therefore, in the above-explained opened state, the opened state can be kept by an engagement of the notch 57 and the engagement member 59. Note that it may be adopted that a notch is formed on the bottom surface of the attachment plate 7 and a plunger mechanism is provided at the upper portion of the clamp 17.

When pushing the clamp 17 by the piston rod 31 (see FIG. 2) is cancelled, the upper portion of the clamp 17 is pushed by the biasing mechanism 45 (see FIG. 3). In this state, the lower portion of the clamp 17 slightly presses the upper tool 21 onto the support portion 23 by the biasing force of the biasing mechanism 45. Therefore, the engagement of the drop prevention member 41 of the clamp 17 and the drop prevention groove 43 of the upper tool 21 is kept, and the upper tool 21 can be prevented from dropping off. In the state where the lower portion of the clamp 17 slightly presses the upper tool 21 onto the support portion 23, the upper tool 21 can be slid laterally. Therefore, in the state where the lower portion of the clamp 17 slightly presses the upper tool 21 onto the support portion 23, the upper tool 21 can be exchanged from a side of the upper tool holder 1.

However, in a case where the upper tool is laterally short, the upper tool 21 may be exchanged from beneath of the upper tool holder 1. In this case, the upper portion of the clamp 17 is pressed backward against the biasing force of the biasing mechanism 45 while holding the upper tool 21 to engage the notch 57 with the engagement member 59 in the plunger mechanism. As a result, a state where the lower portion of the clamp 17 is widely opened is kept, and then the upper tool 21 can be removed downward from the upper tool holder 1.

On the other hand, when attaching the upper tool 21, the upper tool 21 is inserted from beneath into a gap between the support portion 23 and the clamp 17 while the state where the lower portion of the clamp 17 is widely opened is kept, and then the lower portion of the clamp 17 is pressed backward to disengage the notch 57 and the engagement member 59. As a result, the drop prevention member 41 and the drop prevention groove 43 are engaged with each other, and the upper tool 21 is held in a drop prevention state.

Note that the engagement of the notch 57 and the engagement member 59 may be cancelled before the insertion of the upper tool 21 between the support portion 23 and the clamp 17. Also in this case, the clamp 17 is swung to its open direction along with the insertion of the upper tool 21 between the support portion 23 and the clamp 17, so that the pushing pin 49 is pushed back. Then, the drop prevention member 41 and the drop prevention groove 43 are engaged with each other, so that the clamp 17 is swung to its close direction by the biasing force of the coil spring 53 to hold the upper tool 21 in the drop prevention state.

When the working fluid is supplied into the cylinder chamber 27 of the actuator 25 in the engagement state of the drop prevention member 41 and the drop prevention groove 43, the piston rod 31 pushes the upper portion of the clamp 17. As a result, the upper tool 21 is fixed by the lower portion of the clamp 17 and the support portion 23.

By the way, with the upper tool holder disclosed in the above-mentioned Patent Document 1, the screw member of the clamp that contacts with the end of the piston rod is retracted into the clamp when exchanging the upper tool from beneath of the upper tool holder. A distance between the end of the piston rod and the screw member of the clamp is made larger, i.e. the clamp is widely opened, by retracting the screw member into the clamp. Therefore, if the screw member is not brought back to its original state, the clamp cannot be closed sufficiently when the piston rod is projected to fix the upper tool and thereby the fixation of the upper tool becomes insufficient.

However, according to the present embodiment, the piston rod 31 contacts with the contact member (pushed member) 35 to push the clamp 17. The contact member 35 is fixed with the clamp 17 and thereby is not retracted into the clamp 17, so that the piston rod 31 and the contact member 35 bear a steady positional relationship. Therefore, even if the clamp 17 (the engagement of the notch 57 and the engagement member in the plunger mechanism) is not brought back to its original state after the upper tool 21 is attached to the upper tool holder 1 from beneath, the upper tool 21 can be fixed surely with the support portion 23 by the clamp 17 as long as the actuator 25 is actuated.

Note that, in order to prevent an operator from widely-opening the lower portion of the clamp 17 involuntarily, provided is an open restriction mechanism 61 (see FIG. 1) for restricting the clamp 17 from being opened widely from the state where the lower portion of the clamp 17 slightly presses the upper tool 21 onto the support portion 23 (the engagement state of the drop prevention member 41 and the drop prevention groove 43: the state where the upper tool 21 is slidable laterally).

Figure 4:
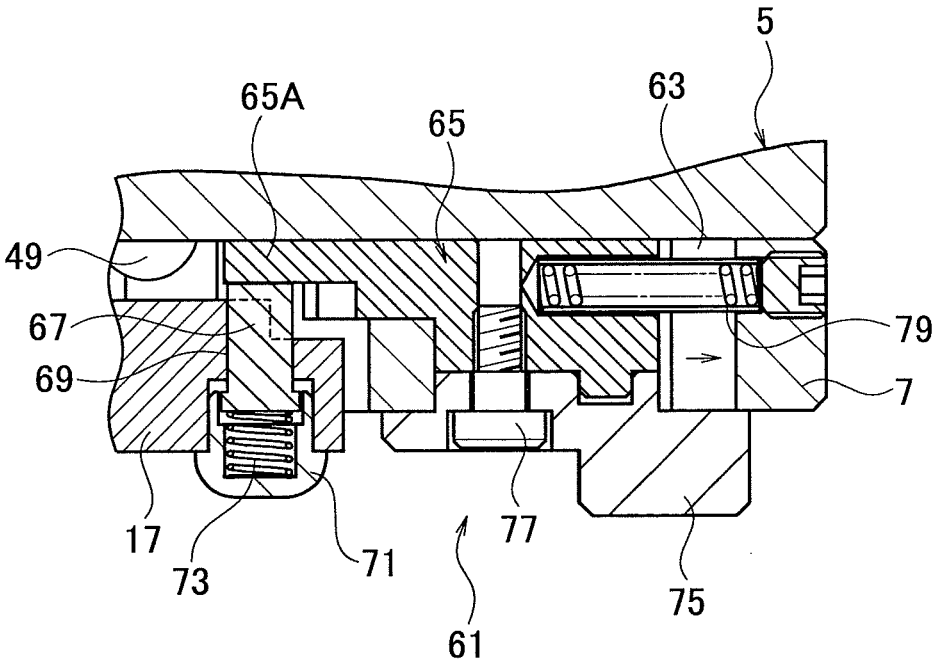
[FIG. 4] It is a cross-sectional view taken along a line IV-IV shown in FIG. 1.

As shown in FIG. 1, the open restriction mechanism is disposed at a position laterally distanced away (rightward in FIG. 1) from a position at which the actuator 25 and the contact member 35 are disposed (a laterally central position of the upper tool holder 1). In the open restriction mechanism 61, a guide hole (long hole) 63 is formed on a front face of the attachment plate 7. Note that the guide hole (long hole) 63 is extended along a direction toward the clamp 17. Although this direction toward the clamp 17 is oriented horizontally in the present embodiment, it may be oriented vertically or obliquely. As shown in FIG. 4, an open restriction member 65 slidable along the guide hole 63 is provided in the guide hole 63.

As shown in FIG. 4, an open restriction portion 65A for restricting the upper portion of the clamp 17 from moving backward (upward in FIG. 4) (restricting the lower portion of the clamp 17 from opening) is formed at an end of the open restriction member 65. In addition, a coil spring (elastic member) 79 is interposed between the open restriction member 65 and the attachment plate 7. The coil spring 79 constantly biases the open restriction member 65 toward its open restriction position (position shown in FIG. 4). On the other hand, a lock pin 67 that contacts with the open restriction portion 65A is provided at a position associated with the open restriction portion 65A set in its restriction state.

A through hole 69 is formed at the upper portion of the clamp 17, and the lock pin 67 is slidably inserted into this through hole 69. In addition, a plug member 71 is threadably mounted into the through hole 69, and a coil spring (elastic member) 73 for biasing the lock pin 67 backward (upward in FIG. 4) is interposed between the plug member 71 and the lock pin 67. The coil spring (elastic member) 73 biases the lock pin 67 backward. Further, a knob 75 for sliding the open restriction member 65 against a biasing force of the coil spring 79 is fixed with the open restriction member 65 by a screw 77.

Therefore, in a state shown in FIG. 4, an end surface of the lock pin 67 contacts with the open restriction member 65 (open restriction portion 65A), so that the upper portion of the clamp 17 can be moved backward until the lock pin 67 bottoms, but cannot be moved further. Namely, the lower portion of the clamp 17 is restricted from opening widely. Note that the above-explained state where the lower portion of the clamp 17 slightly presses the upper tool 21 onto the support portion 23 (the engagement state of the drop prevention member 41 and the drop prevention groove 43: the state where the upper tool 21 is slidable laterally) is achieved before the lock pin 67 bottoms.

On the other hand, when the open restriction member 65 is slid rightward from the state shown in FIG. 4, the open restriction portion 65A is moved to a position where it doesn't contact with the lock pin 67. As a result, the upper portion of the clamp 17 can move further, so that the lower portion of the clamp 17 is widely opened. In addition, when the open restriction member 65 is slid rightward from the state shown in FIG. 4, the lock pin 67 is projected by the coil spring 73. As a result, if the open restriction member 65 is slid toward its original position by the coil spring 79, the open restriction member 65 (open restriction portion 65A) contacts with a side face of an end of the lock pin 67 and thereby cannot return to its open restriction position (position shown in FIG. 4). Namely, a state where the lower portion of the clamp 17 can be widely opened is maintained.

According to the above-explained configuration, when the working fluid is ejected from the cylinder chamber 27 of the actuator 25, the lower portion of the clamp 17 slightly presses the upper tool 21 onto the support portion 23, and thereby the upper tool 21 can be exchanged by sliding it laterally. When it is tried in this state to open the lower portion of the clamp 17, the upper portion (lock pin 67) of the clamp 17 contacts with the open restriction portion 65A of the open restriction member 65. Therefore, the lower portion of the clamp 17 can be restricted from opening widely, and the upper tool 21 can be exchanged safely by sliding the upper tool 21 laterally.

On the other hand, when exchanging the upper tool from beneath of the upper tool holder 1, the open restriction member 65 is slid toward its restriction release direction (rightward in FIG. 4) from the state shown in FIG. 4. When the open restriction member 65 is slid, the open restriction portion 65A is took away from the lock pin 67 and the lock pin 67 is projected by the biasing force of the coil spring 73. If the open restriction member 65 is slid toward its original position by the coil spring 79 after that, the open restriction member 65 contacts with the side face of the end of the lock pin 67 and thereby cannot return to its open restriction position (position shown in FIG. 4). Therefore, the upper portion (lock pin 67) of the clamp 17 is not restricted by the open restriction member 65, and thereby the lower portion of the clamp 17 can be opened widely and the notch 57 and the engagement member 59 can be engaged with each other.

By keeping the lower portion of the clamp 17 in its widely-opened state by the engagement of the notch 57 and the engagement member 59, the upper tool 21 can be exchanged from beneath of the upper tool holder 1. In addition, when the engagement of the notch 57 and the engagement member 59 is disengaged by pressing the lower portion of the clamp 17 backward after the upper tool 21 is inserted between the support portion 23 and the clamp 17, the drop prevention member 41 and the drop prevention groove 43 are engaged with each other.

When the drop prevention groove 43 and the drop prevention member 41 are engaged with each other (the notch 57 and the engagement member 59 are disengaged with each other), a width between the upper portion (lock pin 67) of the clamp and the holder main body 5 becomes wide and the open restriction portion 65A is returned to its original position by the biasing force of the coil spring 79. Namely, the lower portion of the clamp 17 is made restricted from opening widely. Therefore, also in a case where the upper tool 21 is exchanged from beneath the upper tool holder 1, the upper tool 21 can be slid laterally in the drop prevention state.

In addition, regardless of a position of the open restriction member 65 or a state of the plunger mechanism (engagement/disengagement of the notch 57 and the engagement member 59), when the working fluid is supplied into the cylinder chamber 27 of the actuator 25, the clamp 17 is closed to the constant fixed position for fixing the upper tool 21 with the support portion 23 and kept there. Therefore, regardless of a position of the open restriction member 65 or a state of the plunger mechanism, the upper tool 21 can be surely fixed with the support portion 23.

Note that there is a case where a single laterally long upper tool 21 is held by plural upper tool holders 1. In this case, may be occurred a state where the drop prevention groove 43 and the drop prevention member 41 in each of two upper tool holders 1 on both side ends are engaged with each other but the drop prevention groove 43 and the drop prevention member 41 in each of other upper tool holders 1 at the middle of them are disengaged with each other (the notch and the engagement member 59 are still engaged with each other). The actuators 25 are actuated in all of the upper tool holders 1 in this state, and thereby the clamps 17 are closed in all of the upper tool holders 1 to fix the upper tool 21 with the support portions 23. Therefore, the upper tool 21 can be fixed with the support portion 23 by the clamp 17 even in the upper tool holder(s) 1 in which the notch 57 and the engagement member 59 are not disengaged with each other. As a result, the upper tool 21 can be fixed with the support portions 23 even when the notch 57 and the engagement member 59 are not disengaged with each other in some of the plural upper tool holders 1, and thereby safety is improved further.

Note that the present invention is not limited to the above embodiment, and can be adopted in other embodiments with adequate modifications. For example, the actuator 25 is not limited to a fluid pressure cylinder, but may be a ball screw driven by a motor. In this case, the piston rod (pushing member) 31 is stroked by the ball screw.

In addition, in the above embodiment, the open restriction member 65 is provided on the holder main body 5, and the lock pin 67 is provided on the clamp 17. However, the lock pin 67 may be provided on the holder main body 5, and open restriction member 65 may be provided on the clamp 17.

The invention claimed is:

1. An upper tool holder for holding an upper tool of a press brake exchangeably, the upper tool holder comprising:

a holder main body having an upper portion, a vertically intermediate position and a lower portion;

an attachment portion provided on the upper portion of the holder main body, wherein the attachment portion is configured to be connected to an upper table of the press brake;

a support portion configured to be fixed to the upper tool, wherein the support portion is provided on the lower portion of the holder main body;

a clamp having an upper portion, the clamp being coupled to the holder main body by supports such that the clamp is swingable at the vertically intermediate position of the holder main body;

an actuator that includes a pushing member configured to push the upper portion of the clamp, the actuator being configured to fix the upper tool to the support portion by pushing the upper portion of the clamp via the pushing member; and an open restriction member that has an open restriction portion for restricting the clamp from opening from a position configured to hold the upper tool in a laterally slidable state, wherein the open restriction member is provided at a position spaced apart from a pushed position at which the upper portion of the clamp body is pushed by the pushing member.

2. The upper tool holder according to claim 1, wherein, when the pushing member pushes the upper portion of the clamp to fix the upper tool to the support portion, the pushing member keeps the clamp at a constant fixed position regardless of a position of the open restriction member.

3. The upper tool holder according to claim 1, wherein the clamp has a lock pin contactable with the open restriction member, the lock pin is biased toward a direction for projecting an end thereof, a projected direction of the lock pin intersects with a slide direction of the open restriction member, the clamp is restricted from opening by a contact of an end surface of the lock pin with the open restriction portion, when the open restriction member is positioned at an open restriction position for restricting the clamp from opening, and the clamp is allowed to open by a projection of the lock pin and a contact of a side face of an end of the lock pin with the open restriction portion to restrict the open restriction portion from returning to the restriction position, when the open restriction member is not positioned at the open restriction position.

4. The upper tool holder according to claim 1, wherein the supports that couple the clamp to the holder main body comprises support shafts.

* * * * *